US008353333B2

(12) United States Patent
Chen et al.

(10) Patent No.: US 8,353,333 B2
(45) Date of Patent: Jan. 15, 2013

(54) BOARD-SHAPED HEAT DISSIPATING DEVICE AND METHOD OF MANUFACTURING THE SAME

(75) Inventors: Ping Chen, Sinjhuang (TW); Shu-Chun Yu, Sinjhuang (TW)

(73) Assignee: Asia Vital Components Co., Ltd., Sinjhuang, Taipei County (TW)

( * ) Notice: Subject to any disclaimer, the term of this patent is extended or adjusted under 35 U.S.C. 154(b) by 630 days.

(21) Appl. No.: 12/535,120

(22) Filed: Aug. 4, 2009

(65) Prior Publication Data

US 2011/0030922 A1 Feb. 10, 2011

(51) Int. Cl.
*F28F 7/00* (2006.01)
*F28D 15/00* (2006.01)
*H05K 7/20* (2006.01)

(52) U.S. Cl. ..... 165/80.5; 165/104.33; 361/700

(58) Field of Classification Search ..... 165/104.33, 165/80.5; 361/700
See application file for complete search history.

(56) References Cited

U.S. PATENT DOCUMENTS 6,903,930 B2 * 6/2005 DiStefano et al. ..... 361/700
6,918,429 B2 * 7/2005 Lin et al. ..... 165/80.3
6,978,829 B1 * 12/2005 Lin ..... 165/104.33
7,295,437 B2 * 11/2007 Lee et al. ..... 361/700
7,545,645 B2 * 6/2009 Kuan ..... 361/700
2005/0201061 A1 * 9/2005 Nikfar ..... 361/700
2006/0243427 A1 * 11/2006 Kitajima et al. ..... 165/104.33
2007/0169919 A1 * 7/2007 Deng et al. ..... 165/104.33
2008/0035313 A1 * 2/2008 Hsu ..... 165/104.33
2008/0173431 A1 * 7/2008 Yang et al. ..... 165/104.33
2008/0314556 A1 * 12/2008 Zhou et al. ..... 165/80.3
2009/0000768 A1 * 1/2009 Zheng et al. ..... 165/80.3
2009/0095448 A1 * 4/2009 Lai et al. ..... 165/104.33

* cited by examiner

*Primary Examiner* — Judy Swann
*Assistant Examiner* — Jason Thompson

(57) ABSTRACT

A board-shaped heat dissipating device includes a board body having a plane face with a recess formed thereon, a heat conducting element fitted in the recess, at least one groove formed on any one of the board body and the heat conducting element, and at least one heat pipe pressed into the groove to flush with an open side of the groove. After the heat pipe is pressed into the groove and the heat conducting element is firmly fitted in the recess, portions of the heat conducting element that are higher than the plane face are removed through a cut operation, so that the heat conducting element is flush with the plane face of the board body to reduce the space occupied by the heat dissipating device. With the above arrangements, the problem of thermal resistance can be avoided and upgraded overall heat dissipation efficiency can be achieved.

3 Claims, 19 Drawing Sheets

BOARD-SHAPED HEAT DISSIPATING DEVICE AND METHOD OF MANUFACTURING THE SAME

FIELD OF THE INVENTION

The present invention relates to a board-shaped heat dissipating device, and more particularly to a board-shaped heat dissipating device that occupies reduced space, provides upgraded heat dissipation efficiency, and avoids the problem of thermal resistance. The present invention also relates to a method of manufacturing the above-described board-shaped heat dissipating device.

BACKGROUND OF THE INVENTION

The heat produced by electronic elements in various electronic devices increases with the increasing computing speed and data processing capability of the electronic devices. The heat produced by the electronic elements during the operation thereof must be timely removed, lest the heat should adversely affect the operation efficiency of the electronic devices to even cause burnout of the electronic elements thereof. According to a conventional way of removing such heat, a cooling unit is provided on a top of an electronic element. The conventional cooling unit usually includes a heat sink or a plurality of radiating fins and a cooling fan, which work cooperatively to remove the produced heat. In some cases, heat pipes are further provided to cooperate with the cooling unit, so that heat source is guided by the heat pipes to distal ends of the heat pipes and be dissipated into ambient environment. However, since an electronic device usually has only very limited internal space while the number of heat-producing electronic elements in the electronic device is large, the cooling units being correspondingly provided on the electronic elements will become very close to one another in the limited internal space of the electronic device and fail to extend their cooling ability. There is also another conventional heat dissipating way in which heat pipes are embedded in one face of a heat dissipating board to thereby form a heat dissipating element capable of overcoming the drawbacks in the conventional cooling unit and heat pipes. The conventional heat dissipating board includes at least one groove formed on one face of the board for each receiving a heat pipe therein. The heat pipe transfers the heat source to a relatively cold location on the heat dissipating board, so that the heat is dissipated into ambient air from the heat dissipating board. To facilitate easy positioning of the heat pipe in the groove, the groove is usually formed with a somewhat large allowance. Therefore, there would be a clearance left between the groove and the heat pipe positioned therein. Such clearance tends to cause thermal resistance to adversely affect the heat dissipation efficiency of the conventional heat dissipating board. Further, when the heat pipe is associated with the groove through welding, the heated surface of the heat pipe will expand to adversely affect the accuracy in assembling the heat pipe to the groove. In brief, the conventional heat dissipating board has the following disadvantages: (1) poor heat dissipation efficiency; and (2) poor assembling accuracy.

SUMMARY OF THE INVENTION

It is therefore a primary object of the present invention to provide a board-shaped heat dissipating device that provides high heat dissipation efficiency.

Another object of the present invention is to provide a method of manufacturing a board-shaped heat dissipating device that avoids the problem of thermal resistance.

A further object of the present invention is to provide a board-shaped heat dissipating device that occupies reduced space.

To achieve the above and other objects, the board-shaped heat dissipating device according to the present invention includes a board body, at least one heat conducting element, at least one groove, and at least one heat pipe. The board body has at least one plane face with at least one recess formed thereon. The heat conducting element has a first side correspondingly associated with the recess and an opposite second side flushing with the plane face of the board body. The at least one groove can be formed on any one of the board body and the heat conducting element, and has a closed side and an open side. The at least one heat pipe is embedded in the at least one groove and has an embedded face correspondingly associated with the closed side of the groove and a contact face flushing with the open side of the groove.

And, the method of manufacturing the board-shaped heat dissipating device of the present invention includes the following steps: forming at least one recess on a plane face of a board body; selectively forming at least one groove on a bottom face of the recess or a first side of a heat conducting element; applying a heat-conducting bonding medium in the formed groove; correspondingly placing at least one heat pipe in the at least one groove, pressing the at least one heat pipe against the board body or the heat conducting element and welding the at least one heat pipe to the at least one groove; fitting the first side of the heat conducting element in the recess and welding the heat conducting element to the board body; and conducting a cut operation to remove portions on a second side of the heat conducting element that are higher than the plane face of the board body, so that the second side of the heat conducting element is flush with the plane face of the board body to reduce the space occupied by the heat dissipating device. With the above arrangements, the problem of thermal resistance can be avoided and upgraded overall heat dissipation efficiency can be achieved.

In brief, the board-shaped heat dissipating device of the present invention provides at least the following advantages: (1) occupying only reduced space; (2) having excellent heat dissipation efficiency; and (3) avoiding the problem of thermal resistance.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
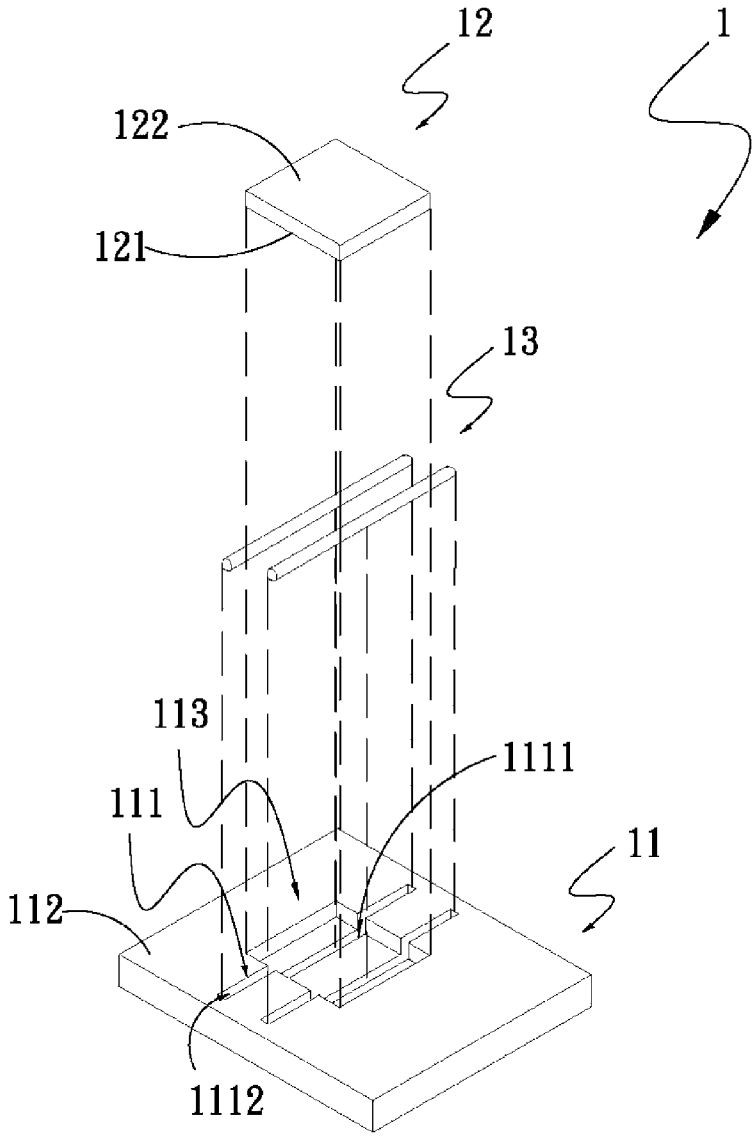
FIG. 1 is an exploded perspective view of a board-shaped heat dissipating device according to a first embodiment of the present invention.
Figure 2:
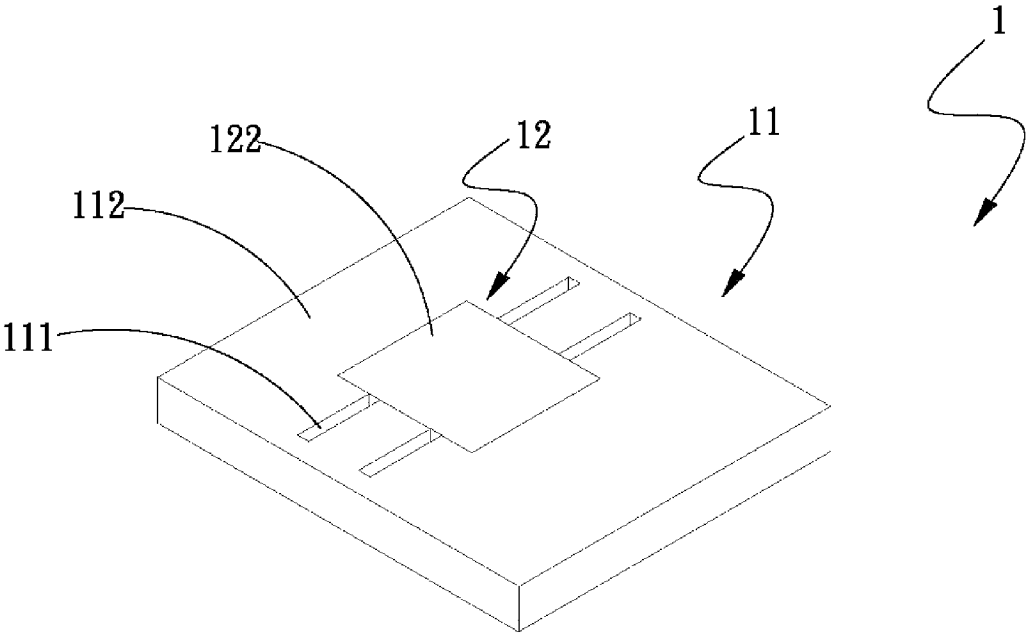
FIG. 2 is an assembled perspective view of the board-shaped heat dissipating device of FIG. 1.
Figure 3:
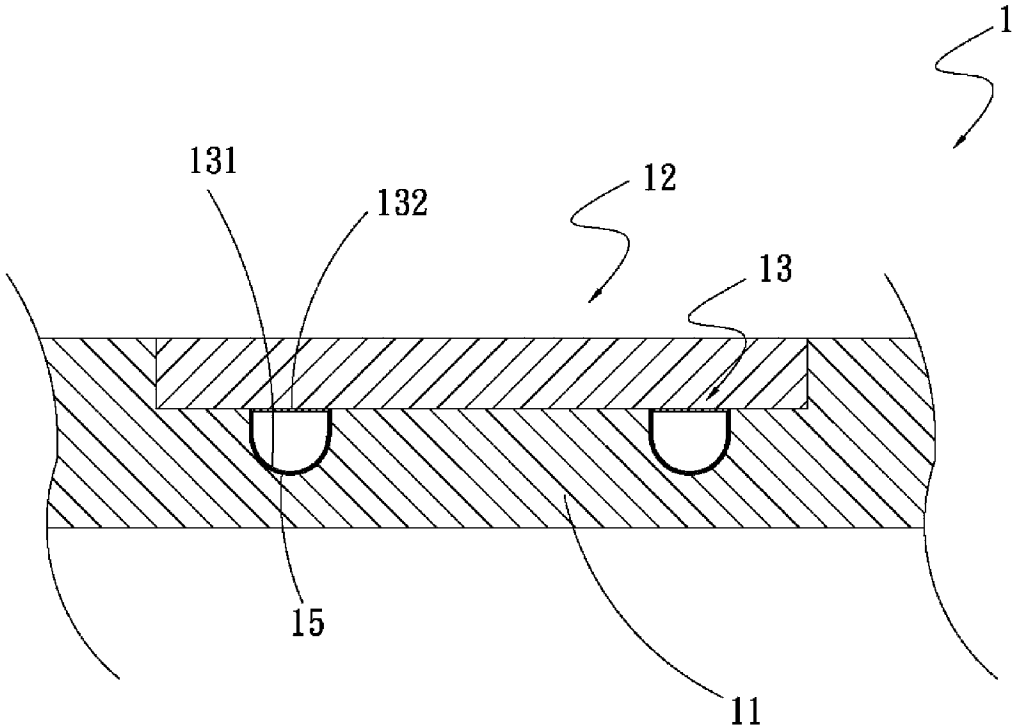
FIG. 3 is a fragmentary and enlarged sectional view of the board-shaped heat dissipating device of FIG. 1.

Please refer to FIGS. 1 and 2 that are exploded and assembled perspective views, respectively, of a board-shaped heat dissipating device 1 according to a first embodiment of the present invention, and to FIG. 3 that is a fragmentary and enlarged sectional view of FIG. 2. As shown, the board-shaped heat dissipating device 1 in the first embodiment includes a board body 11, at least one heat conducting element 12, at least one groove 111, and at least one heat pipe 13. In the illustrated first embodiment, there are provided one heat conducting element 12, two grooves 111 and two heat pipes 13. The board body 11 has at least one plane face 112, on which at least one recess 113 is formed. The heat conducting element 12 has a first side 121 being correspondingly associated with the recess 113, and a second side 122 opposite to the first side 121 and flushing with the plane face 112 of the board body 11. The grooves 111 are formed on the board body 11, and each of the grooves 111 has a closed side 1111 and an open side 1112. The heat pipes 13 are received in the grooves 111 in one-to-one correspondence, and each of the heat pipes 13 includes an embedded face 131 correspondingly associated with the closed side 1111 of the groove 111 and a contact face 132 corresponding to and flushing with the open side 1112 of the groove 111. A heat-conducting bonding medium 15, which can be any one of solder paste and solder stick, is applied on the closed side 1111 of each of the grooves 111. The contact face 132 of each of the heat pipes 13 is located opposite to the embedded face 131, and has two lateral edges joining two lateral edges of the embedded face 131. The contact face 132 is a flat face, and the embedded face 131 has a cross sectional shape the same as that of the closed side 1111 of the groove 111. Further, the heat conducting element 12 is made of a material selected from the group consisting of copper and aluminum.

Figure 4:
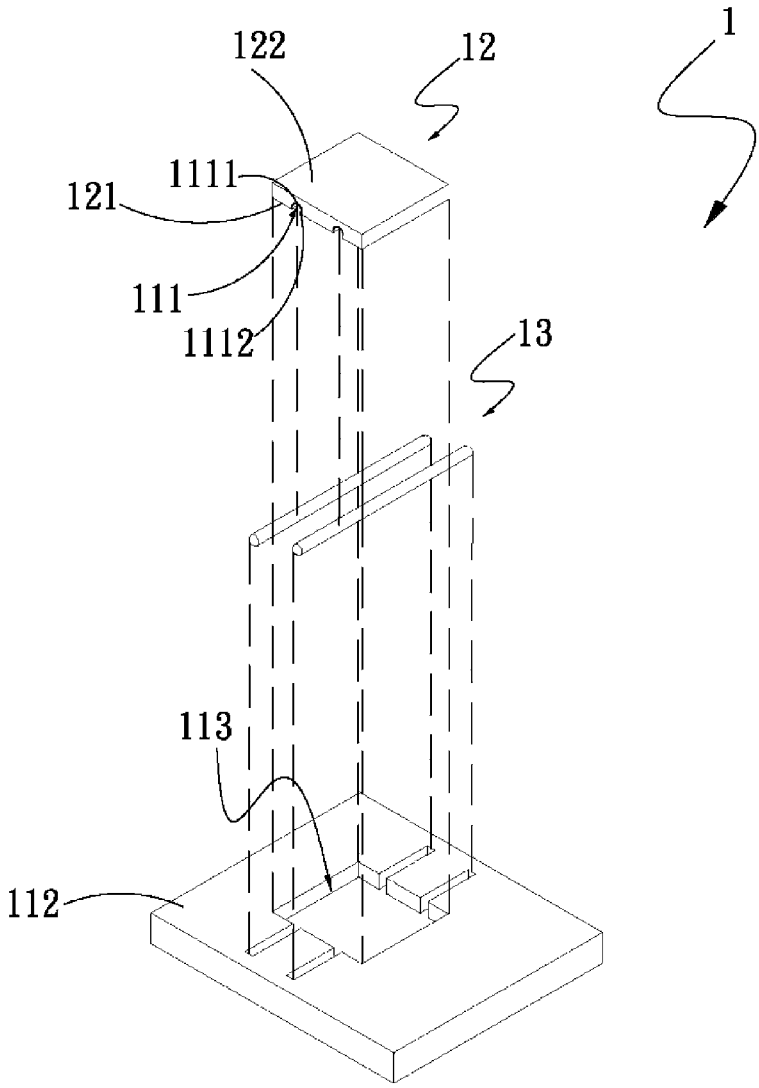
FIG. 4 is an exploded perspective view of a board-shaped heat dissipating device according to a second embodiment of the present invention.
Figure 5:
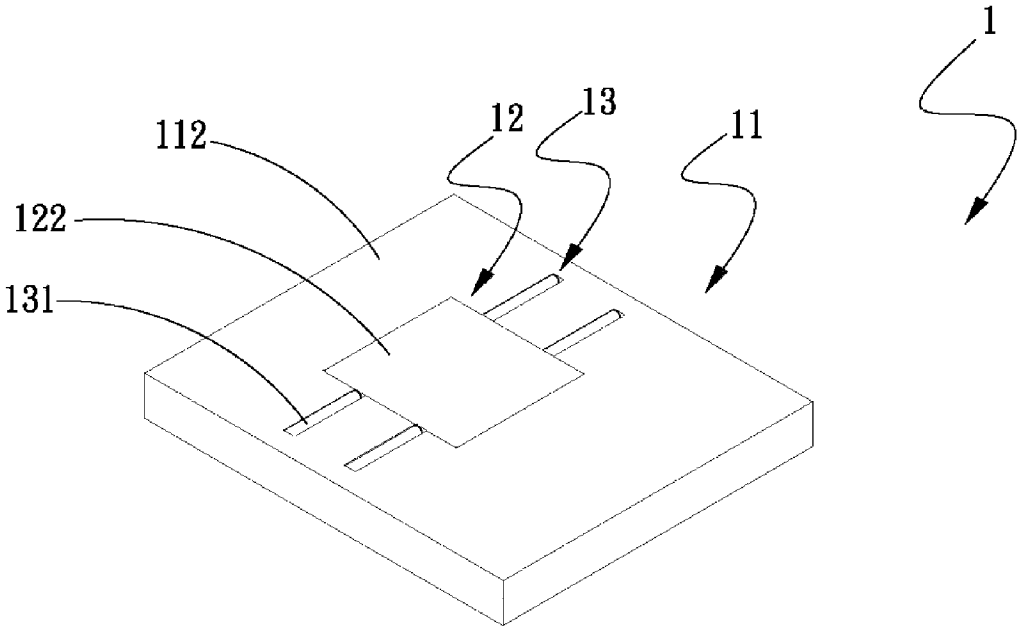
FIG. 5 is an assembled perspective view of the board-shaped heat dissipating device of FIG. 4.
Figure 6:
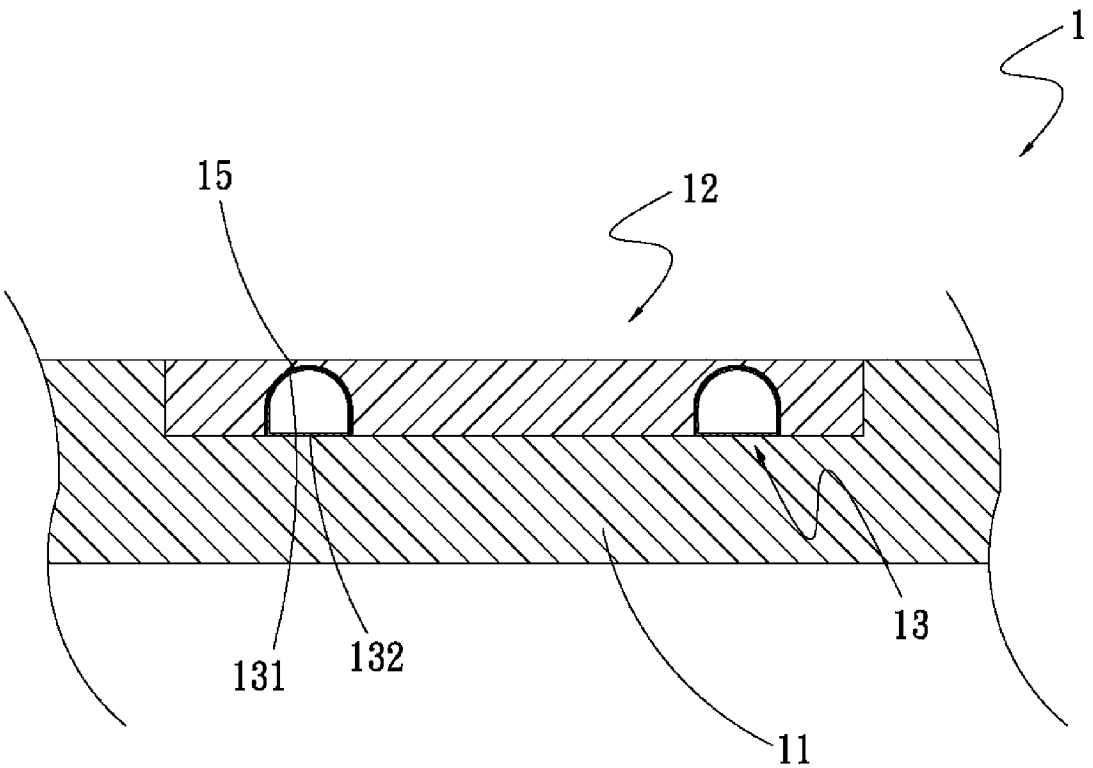
FIG. 6 is a fragmentary and enlarged sectional view of the board-shaped heat dissipating device of FIG. 5.
Figure 7:
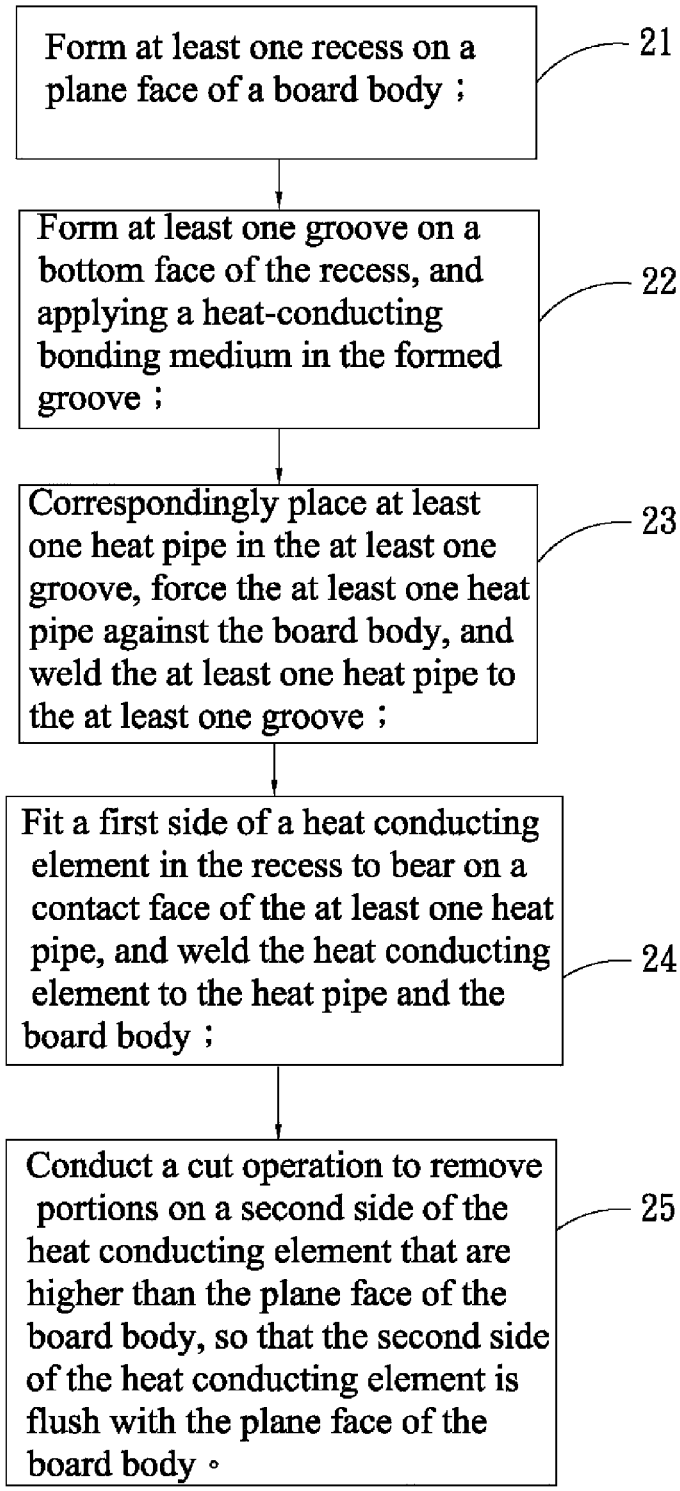
FIG. 7 is a flowchart showing the steps included in a first method for manufacturing the board-shaped heat dissipating device of FIG. 1.

FIGS. 4 and 5 are exploded and assembled perspective views, respectively, of a board-shaped heat dissipating device 1 according to a second embodiment of the present invention, and FIG. 6 is a fragmentary and enlarged sectional view of FIG. 5. As shown, the board-shaped heat dissipating device 1 in the second embodiment includes a board body 11, at least on heat conducting element 12, at least one groove 111, and at least one heat pipe 13. In the illustrated second embodiment, there are provided one heat conducting element 12, two grooves 111 and two heat pipes 13. The board body 11 has at least one plane face 112, on which at least one recess 113 is formed. The heat conducting element 12 has a first side 121 correspondingly associated with the recess 113, and a second side 122 opposite to the first side 121 and flushing with the plane face 112 of the board body 11. The grooves 111 are formed on the first side 121 of the heat conducting element 12, and each of the grooves 111 has a closed side 1111 and an open side 1112. The heat pipes 13 are received in the grooves 111 in one-to-one correspondence, and each of the heat pipes 13 includes an embedded face 131 correspondingly associated with the closed side 1111 of the groove 111 and a contact face 132 corresponding to and flushing with the open side 1112 of the groove 111. A heat-conducting bonding medium 15, which can be any one of solder paste and solder stick, is applied on the closed side 1111 of each of the grooves 111. The contact face 132 of each of the heat pipes 13 is located opposite to the embedded face 131, and has two lateral edges joining two lateral edges of the embedded face 131. The contact face 132 is a flat face, and the embedded face 131 has a cross sectional shape the same as that of the closed side 1111 of the groove 111. Further, the heat conducting element 12 is made of a material selected from the group consisting of copper and aluminum.

Figure 8:
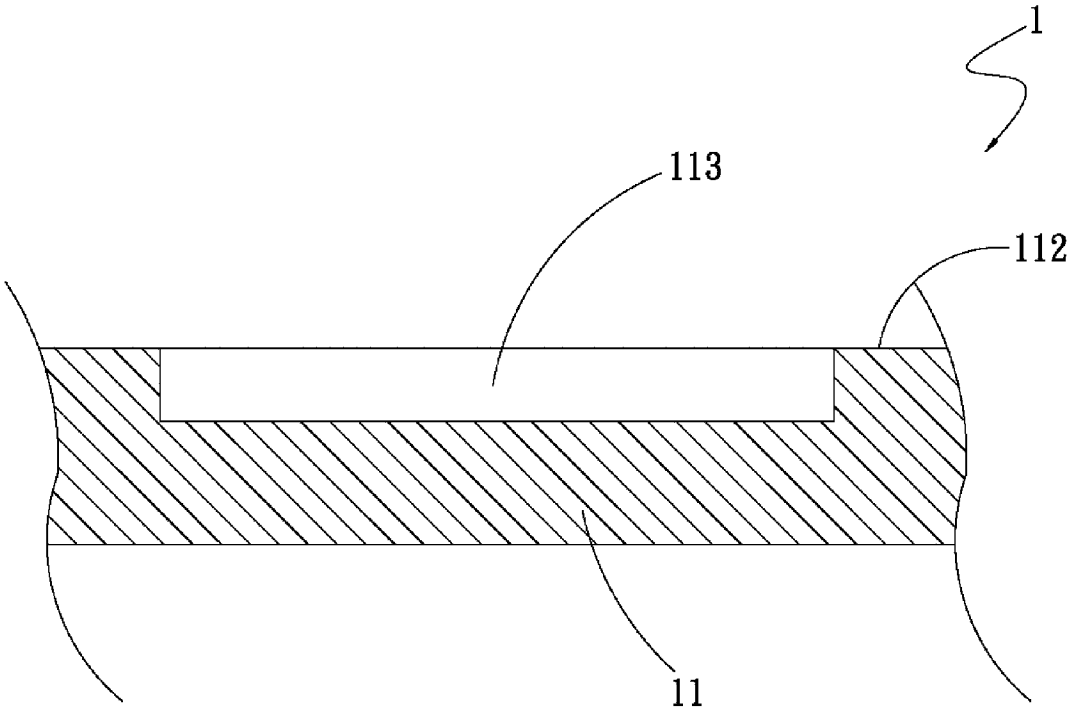
FIGS. 8 to 13 are sectional views illustrating the manufacture of the board-shaped heat dissipating device of FIG. 1 according to the first method of the present invention.

FIG. 4 is a flowchart showing the steps included a first method for manufacturing the board-shaped heat dissipating device 1 according to the first embodiment of the present invention; and FIGS. 8 to 13 are sectional views illustrating the manufacture of the board-shaped heat dissipating device 1 using the first method of FIG. 4. The first method includes the following steps:

Step 21: Forming at least one recess on a plane face of a board body. In the step 21, as shown in FIG. 8, the board body 11 has a plane face 112, on which at least one recess 113 is formed through milling or other cut operations. In the illustrated first manufacturing method, the recess 113 is formed by milling. However, it is understood the recess 113 can be formed in other manners without being limited to milling. Further, the recess 113 can have a square, a round, or any other geometrical shape. In the illustrated first manufacturing method, the recess 113 is square in shape. However, it is understood the recess 113 is not limited to the square shape. Basically, the recess 113 has a shape corresponding to that of a heat conducting element 12 to be received therein.

Figure 9:
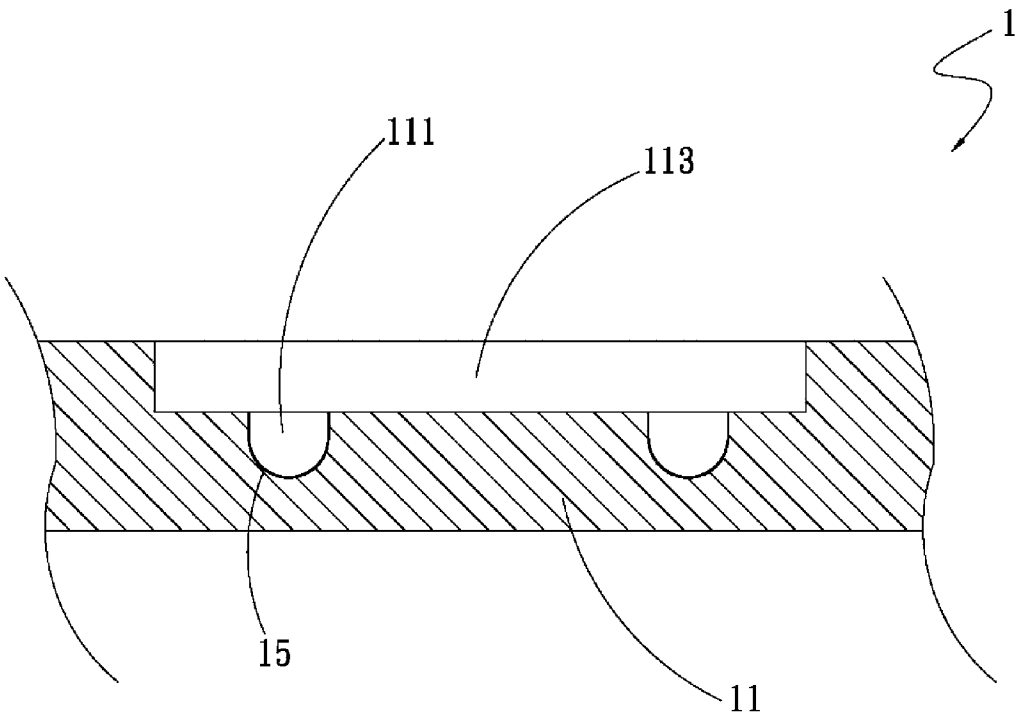

Step 22: Forming at least one groove on a bottom face of the recess, and applying a heat-conducting bonding medium in the formed groove. In the step 22, at least one groove 111 is formed on a bottom face of the recess 113 through milling or other machining manners, and a heat-conducting bonding medium 15 is applied in the groove 111, as shown in FIG. 9. The heat-conducting bonding medium 15 can be any one of solder paste and solder stick.

Figure 10:
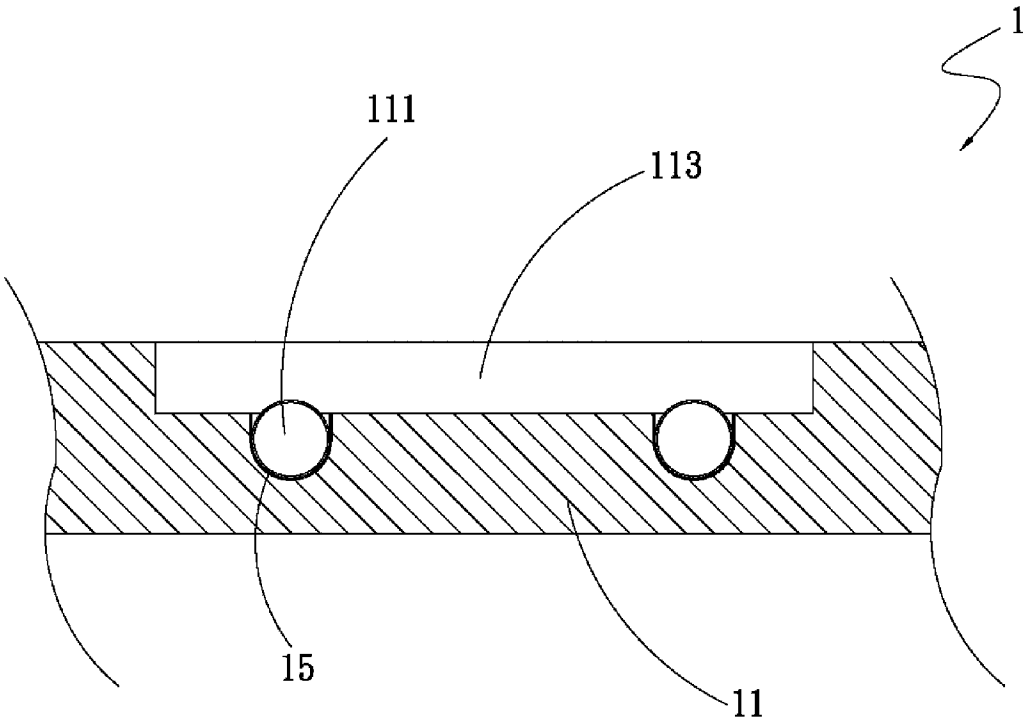
Figure 11:
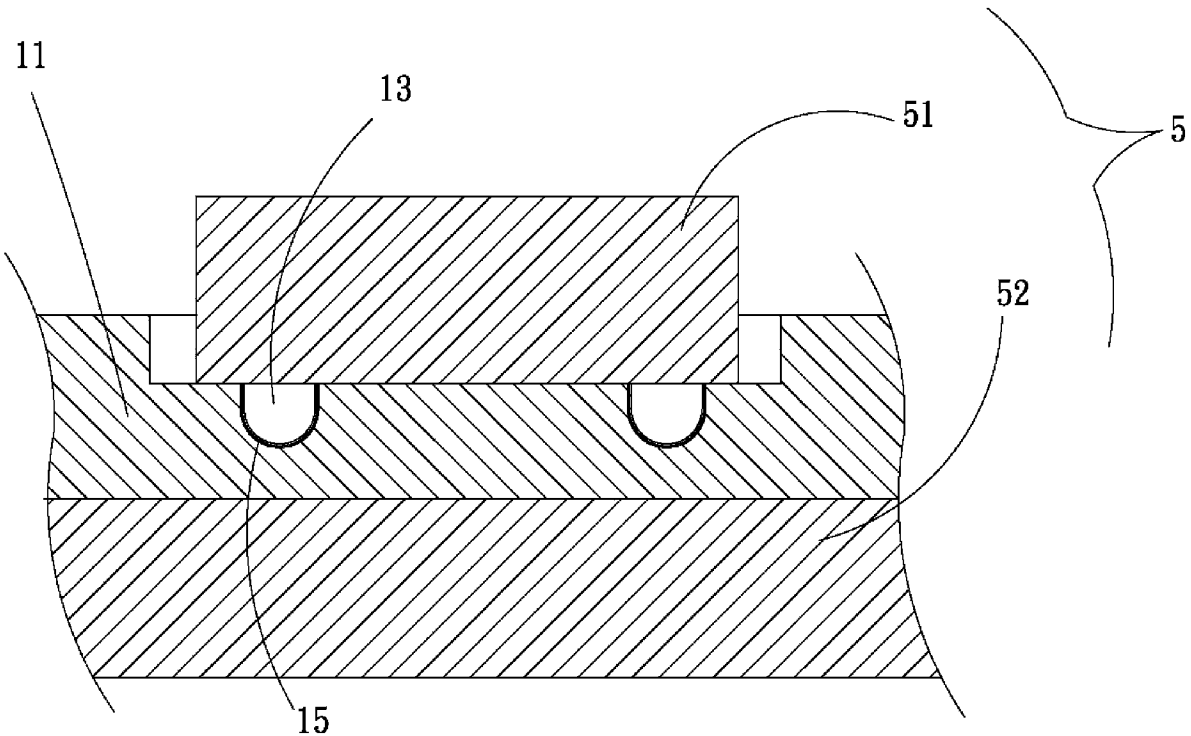

Step 23: Correspondingly placing at least one heat pipe in the at least one groove, forcing the at least one heat pipe against the board body, and welding the at least one heat pipe to the at least one groove. In the step 23, as shown in FIG. 10, at least one heat pipe 13 is correspondingly placed in the at least one groove 111, and the heat pipe 13 in the groove 111 is properly adjusted in position in order to closely attach to the groove 111. Then, the board body 11 with the at least one heat pipe 13 is positioned between an upper mold 51 and a lower mold 52 of a press machine 5, as shown in FIG. 11. When the upper mold 51 is pressed against the board body 11 and the at least one heat pipe 13 placed in the groove 111, the heat pipe 13 is firmly forced into the groove 111, such that a bottom side of the heat pipe 13 is tightly attached to and associated with the groove 111, and a top side of the heat pipe 13 is flattened to provide a contact face.

Figure 12:
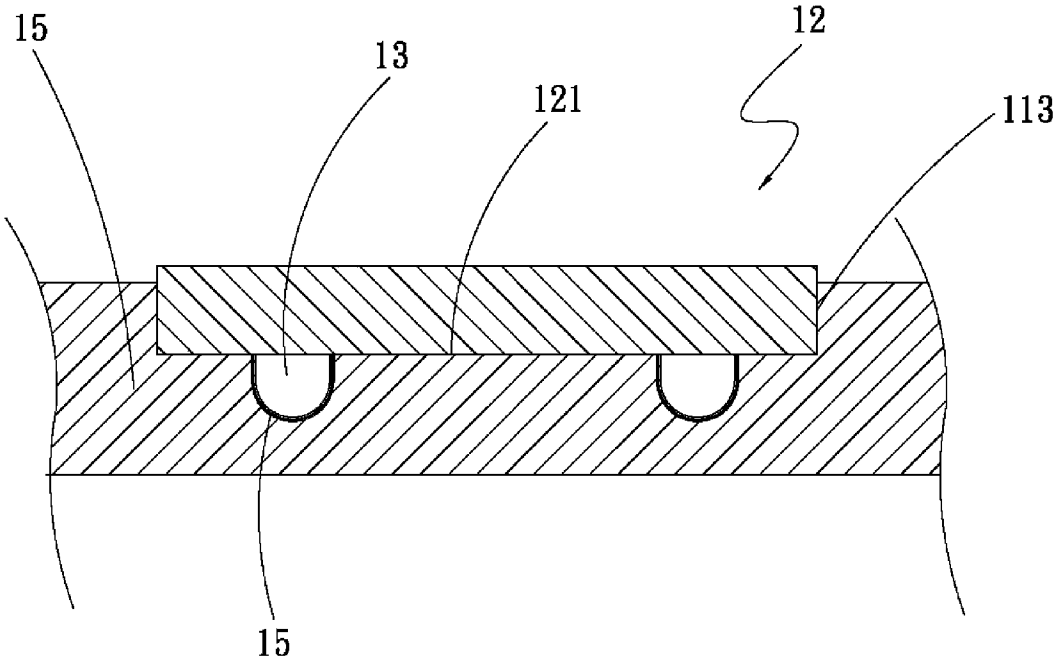

Step 24: Fitting a first side of a heat conducting element in the recess to bear on the contact face of the at least one heat pipe, and welding the heat conducting element to the heat pipe and the board body. In the step 24, as shown in FIG. 12, a heat conducting element 12 is fitted in the recess 113 with a first side 121 of the heat conducting element 12 correspondingly contacting with the bottom face of the recess 113 and tightly bearing against the contact face of the at least one heat pipe 13. And then, the board body 11, the heat pipe 13 and the heat conducting element 12 are welded to one another to remove any clearance among them.

Figure 13:
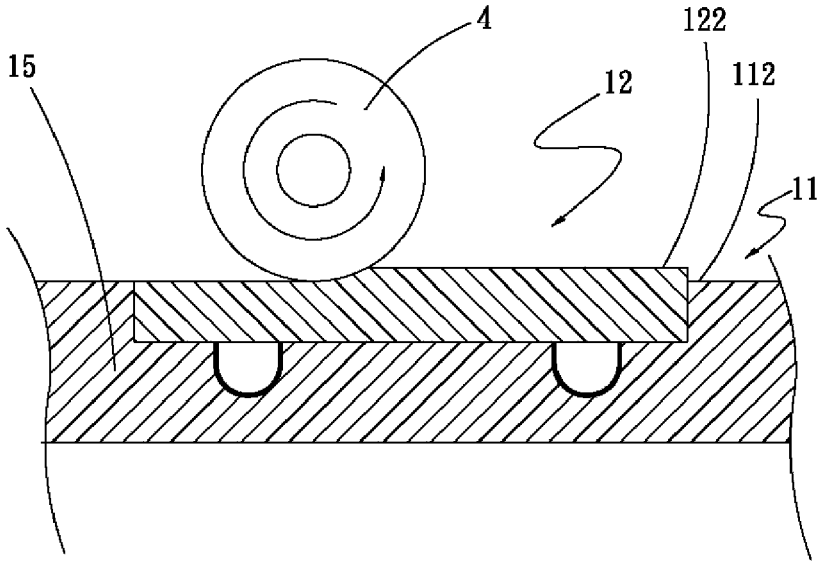

Step 25: Conducting a cut operation to remove portions on a second side of the heat conducting element that are higher than the plane face of the board body, so that the second side of the heat conducting element is flush with the plane face of the board body. In the step 25, as shown in FIG. 13, portions on a second side 122 of the heat conducting element 12 that are higher than the plane face 112 of the board body 11 are removed through a cut operation, so that the second side 122 of the heat conducting element 12 is flush with the plane face 112 to reduce the space being occupied by the heat dissipating device 1 and avoid the problem of thermal resistance. The cut operation can be any one of milling, grinding, and planning. In the illustrated first method, a sand wheel 4 is used to grind off the portions on the second side 122 of the heat conducting element 12 that are higher than the plane face 112 of the board body 11.

Figure 14:
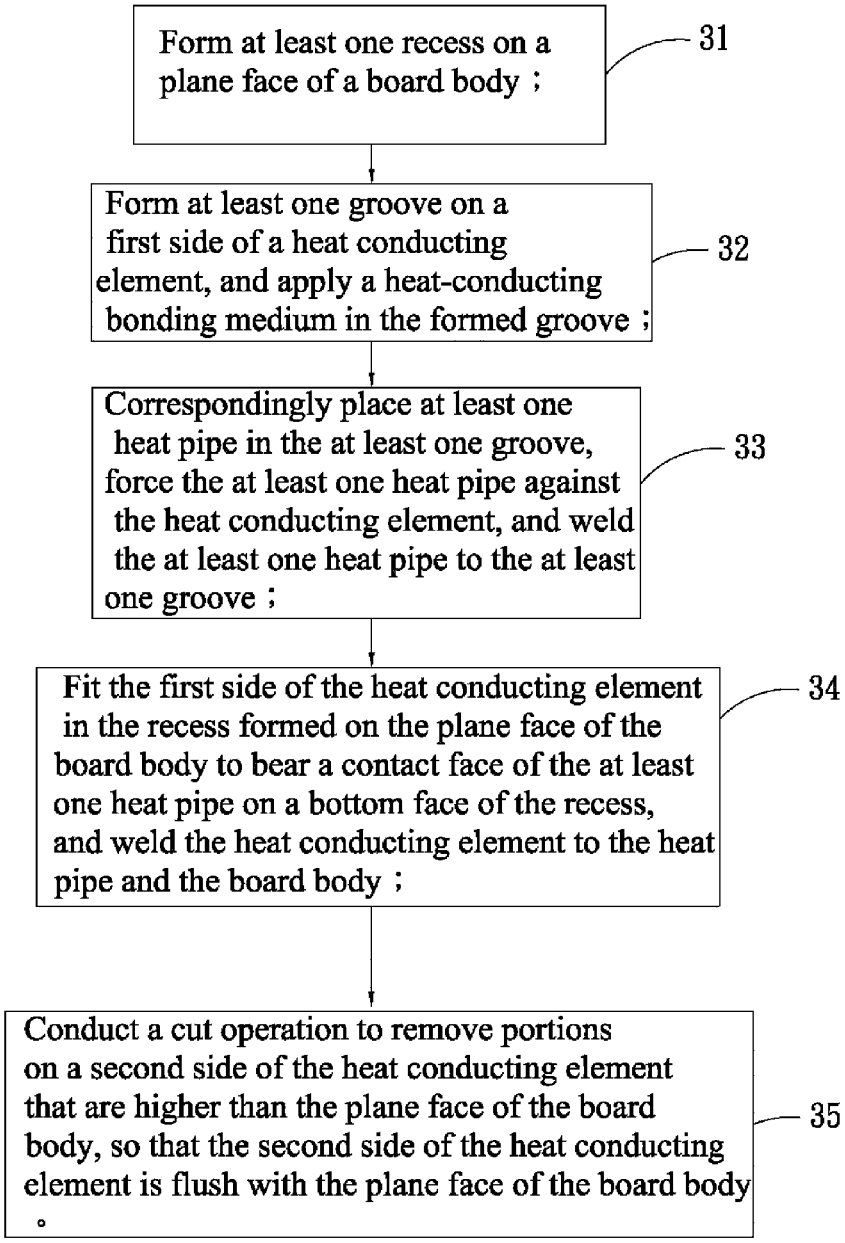
FIG. 14 is a flowchart showing the steps included in a second method for manufacturing the board-shaped heat dissipating device of FIG. 4.
Figure 15:
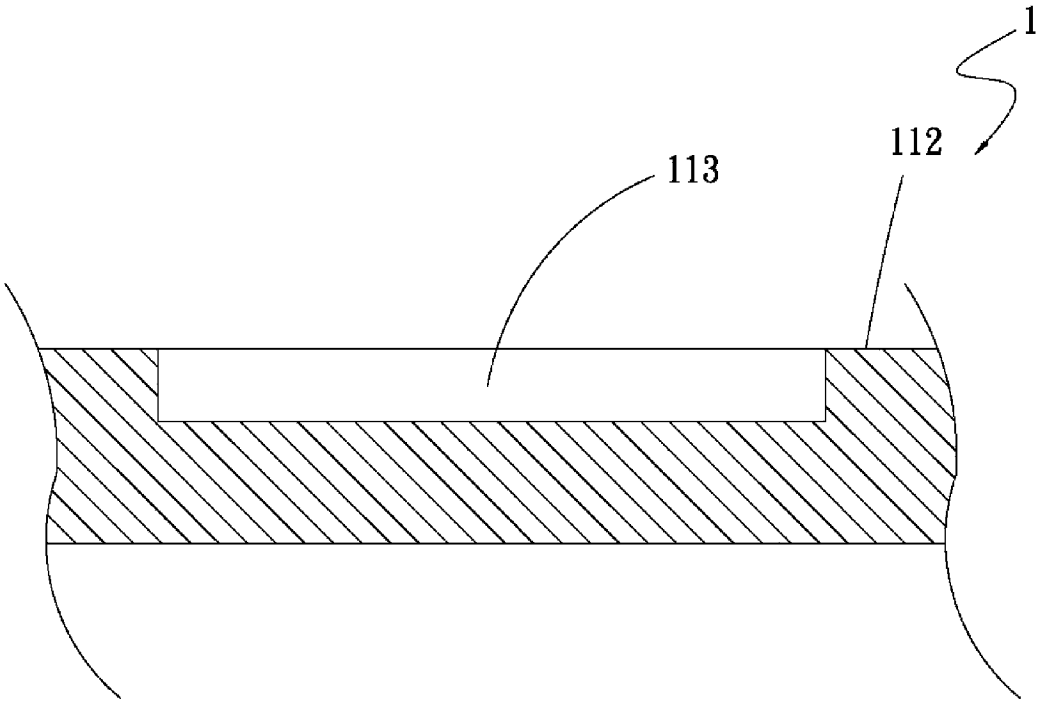
FIGS. 15 to 19 are sectional views illustrating the manufacture of the board-shaped heat dissipating device of FIG. 4 according to the second method of the present invention.

FIG. 14 is a flowchart showing the steps included a second method for manufacturing the board-shaped heat dissipating device 1 according to the second embodiment of the present invention; and FIGS. 15 to 19 are sectional views illustrating the manufacture of the board-shaped heat dissipating device 1 using the second method of FIG. 14. The second method includes the following steps:

Step 31: Forming at least one recess on a plane face of a board body. In the step 31, as shown in FIG. 15, the board body 11 has a plane face 112, on which at least one recess 113 is formed through milling or other cut operations. In the illustrated second manufacturing method, the recess 113 is formed by milling. However, it is understood the recess 113 can be formed in other manners without being limited to milling. Further, the recess 113 can have a square, a round, or any other geometrical shape. In the illustrated first manufacturing method, the recess 113 is square in shape. However, it is understood the recess 113 is not limited to the square shape. Basically, the recess 113 has a shape corresponding to that of a heat conducting element 12 to be received therein.

Figure 16:
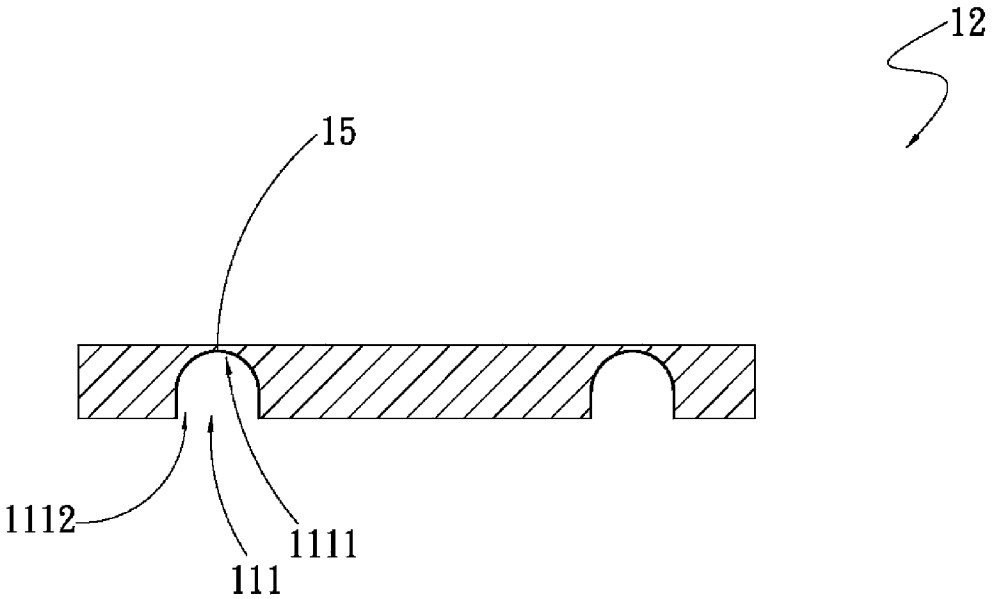

Step 32: Forming at least one groove on a first side of a heat conducting element, and applying a heat-conducting bonding medium in the formed groove. In the step 32, at least one groove 111 is formed on a first side 121 of a heat conducting element 12 through milling or other cutting manners, and a heat-conducting bonding medium 15 is applied in the groove 111, as shown in FIG. 16. The heat-conducting bonding medium 15 can be any one of solder paste and other heat-conducting media that have good heat conducting performance and bonding ability.

Figure 17:
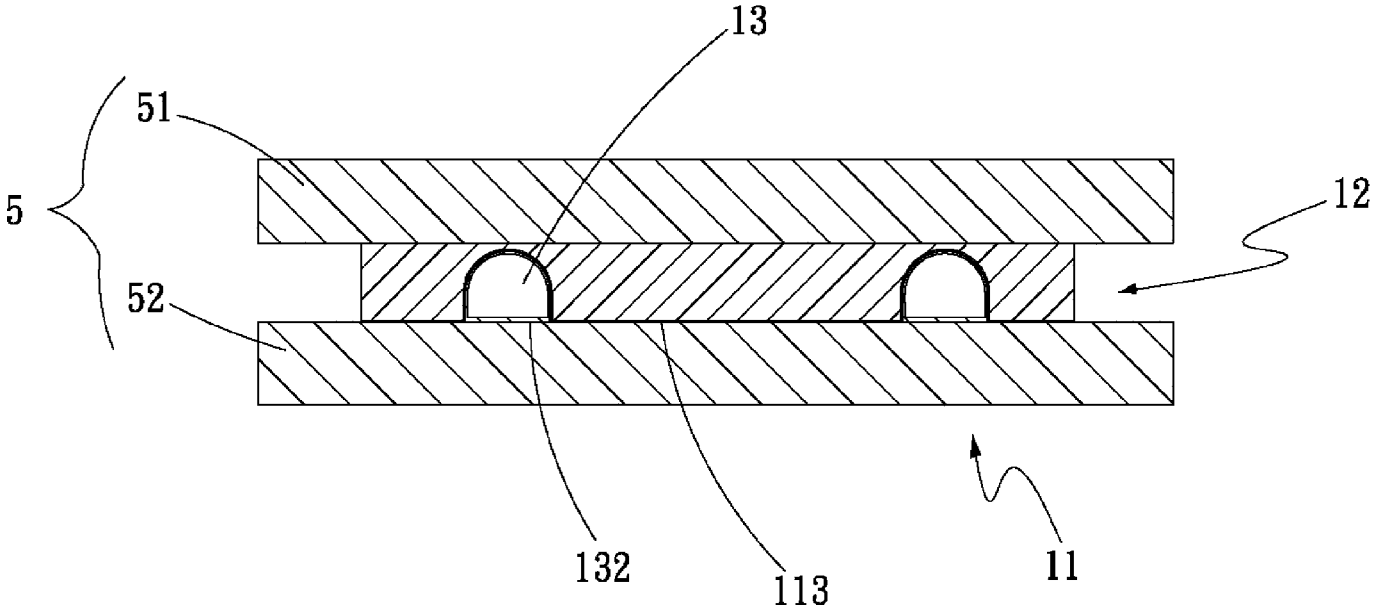

Step 33: Correspondingly placing at least one heat pipe in the at least one groove, forcing the at least one heat pipe against the heat conducting element, and welding the at least one heat pipe to the at least one groove. In the step 33, as shown in FIG. 17, at least one heat pipe 13 is correspondingly placed in the at least one groove 111, and the heat pipe 13 in the groove 111 is properly adjusted in position in order to closely attach to the face of a closed side 1111 of the groove 111. Then, the heat conducting element 12 with the at least one heat pipe 13 is positioned between an upper mold 51 and a lower mold 52 of a press machine 5, as shown in FIG. 17. When the upper mold 51 is pressed against the heat conducting element 12 and the at least one heat pipe 13 placed in the groove 111, the heat pipe 13 is firmly forced into the groove 111 to associate with the groove 111, and a bottom side of the heat pipe 13 is flattened to provide a contact face 132. Meanwhile, the heat pipe 13 is welded to the groove 111 to ensure firm and stable association of the two with each other, and to remove any clearance between the heat pipe 13 and the groove 111 to avoid thermal resistance.

Figure 18:
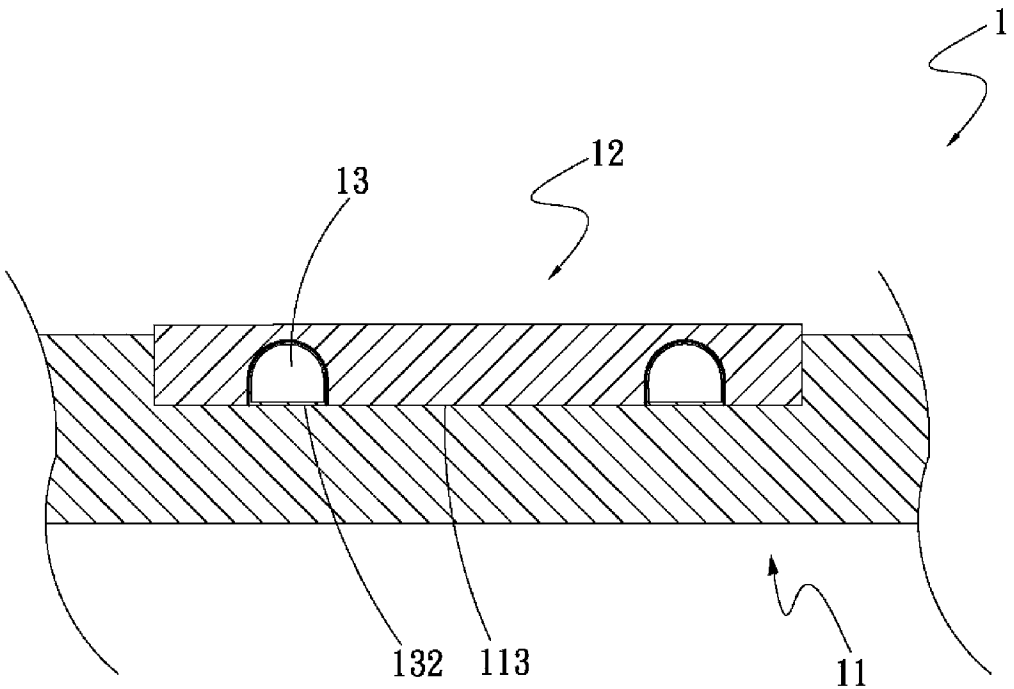

Step 34: Fitting the first side of the heat conducting element in the recess formed on the plane face of the board body to bear the contact face of the at least one heat pipe on a bottom face of the recess, and welding the heat conducting element to the heat pipe and the board body. In the step 34, as shown in FIG. 18, the heat conducting element 12 is fitted in the recess 113 with the contact face 132 of the heat pipe 13 firmly bearing on a bottom face of the recess 113. And then, the at least one groove 111, the at least one heat pipe 13 and the heat conducting element 12 are welded to one another to ensure firm and tight connection of them to one another and to remove any clearance among them to avoid thermal resistance.

Figure 19:
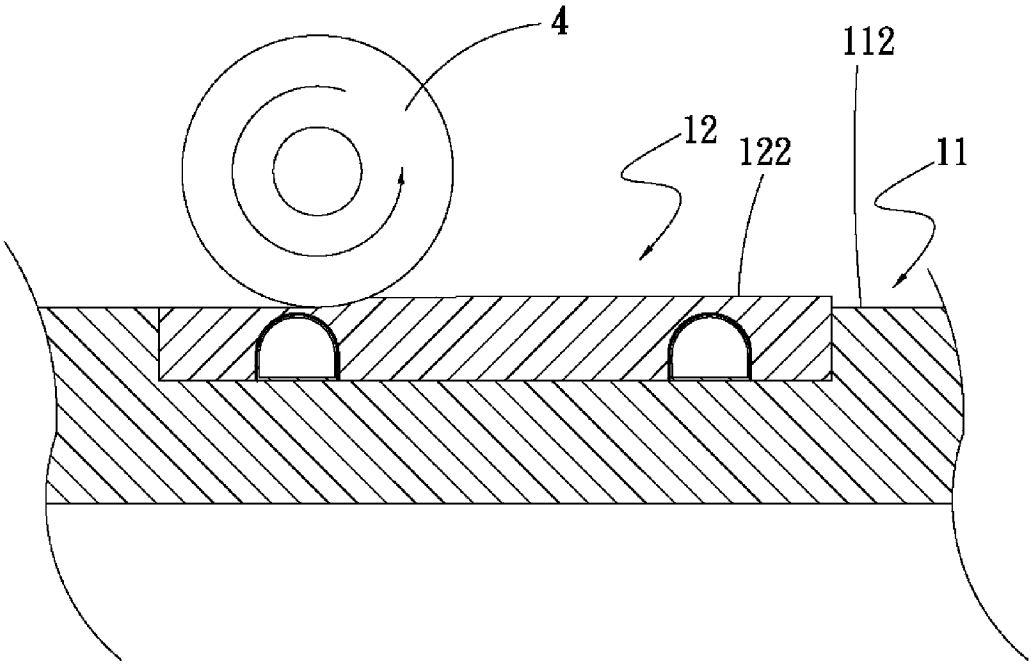

Step 35: Conducting a cut operation to remove portions on a second side of the heat conducting element that are higher than the plane face of the board body, so that the second side of the heat conducting element is flush with the plane face of the board body. In the step 35, as shown in FIG. 19, portions on a second side 122 of the heat conducting element 12 that are higher than the plane face 112 of the board body 11 are removed through a cut operation, so that the second side 122 of the heat conducting element 12 is flush with the plane face 112 to reduce the space being occupied by the heat dissipating device 1 and avoid the problem of thermal resistance. The cut operation can be any one of milling, grinding, and planning. In the illustrated first method, a sand wheel 4 is used to grind off the portions on the second side 122 of the heat conducting element 12 that are higher than the plane face 112 of the board body 11.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A board-shaped heat dissipating device, comprising:

a board body having at least one plane face with at least one recess formed thereon;

at least one heat conducting element having a first side and an opposite second side; the first side being correspondingly associated with the at least one recess, and the second side being flush with the at least one plane face of the board body;

at least one groove being formed on any one of the board body and the heat conducting element, and having a closed side and an open side;

at least one heat pipe being correspondingly embedded in the at least one groove along its entire length and having an embedded face and a contact face; the embedded face being correspondingly associated with the closed side of the groove, and the contact face being flush with the open side of the groove, wherein the contact face of the at least one heat pipe is located opposite to the embedded face thereof and has two lateral edges joining two lateral edges of the embedded face; the contact face being a flat face, and the embedded face having a cross sectional shape the same as that of the closed side of the at least one groove; and wherein the heat conducting element is made of a material selected from the group consisting of copper and aluminum.

2. The board-shaped heat dissipating device as claimed in claim 1, further comprising a heat-conducting bonding medium being applied on the closed side of the at least one groove.

3. The board-shaped heat dissipating device as claimed in claim 2, wherein the heat-conducting bonding medium is selected from the group consisting of solder paste and solder stick.

* * * * *